United States Patent [19]

Hovis et al.

[11] Patent Number: 4,867,140

[45] Date of Patent: Sep. 19, 1989

[54] FLUID-ACTUATED MEDICAL SUPPORT

[76] Inventors: Donald B. Hovis, 3424 Grankforks Road, Mississauga, Ontario, Canada, L4Y 3M9; Edward T. Schneider, 8729 Hilltop Dr., Mentor, Ohio 44094; William L. Hassler, 315 Vassar Ave., Elyria, Ohio 44035; Richard J. Brom, 37297 Lake Shore Blvd., Eastlake, Ohio 44094

[21] Appl. No.: 136,502

[22] Filed: Dec. 28, 1987

Related U.S. Application Data

[63] Continuation of Ser. No. 864,769, May 19, 1986, abandoned.

[51] Int. Cl.[4] ..... A61H 1/00; A47C 27/10; A47C 27/08; A61G 7/06

[52] U.S. Cl. ..... 128/24 R; 128/26; 5/442; 5/443; 5/455

[58] Field of Search ..... 128/33, 38–40, 128/64, 24 R, 26; 5/441, 442, 443, 447, 453, 454, 456, 466, 455; 272/67

[56] References Cited

U.S. PATENT DOCUMENTS

| | | | |
|---|---|---|---|
| 2,055,128 | 9/1936 | Herrmann | 128/38 |
| 2,088,044 | 7/1937 | Tate | 128/38 |
| 2,235,138 | 3/1941 | Billetter | 128/38 |
| 2,245,909 | 6/1941 | Enfiajian | 128/33 |
| 2,460,245 | 1/1949 | Summerville | 128/33 |
| 2,773,499 | 12/1956 | Zur Nieden . | |
| 2,940,441 | 6/1960 | Demarest et al. . | |
| 2,940,442 | 6/1960 | Wilhelm . | |
| 2,998,817 | 9/1961 | Armstrong | 128/33 |
| 3,008,465 | 11/1961 | Gal | 128/33 |
| 3,062,203 | 11/1962 | Ziff | 128/33 |
| 3,086,518 | 4/1963 | Barlow . | |
| 3,164,151 | 1/1965 | Nicoll . | |
| 3,168,094 | 2/1965 | Siltamaki . | |
| 3,207,512 | 9/1965 | Kinsey . | |
| 3,297,023 | 1/1967 | Foley | 5/453 |
| 3,308,489 | 3/1967 | Winkler | 5/441 |
| 3,420,229 | 1/1969 | Miller . | |
| 3,446,203 | 5/1969 | Murray | 5/453 |
| 3,477,071 | 11/1969 | Emerson | 5/453 |
| 3,492,988 | 2/1970 | De Maré | 5/453 |
| 3,621,839 | 11/1971 | Barthe . | |
| 3,644,949 | 2/1972 | Diamond | 5/441 |
| 3,716,049 | 2/1973 | Kaplan . | |
| 3,765,412 | 10/1973 | Ommaya et al. . | |
| 3,771,518 | 11/1973 | Greissing . | |
| 3,811,431 | 5/1974 | Apstein | 128/64 |
| 3,862,629 | 1/1975 | Rotta | 128/24 R |
| 3,892,229 | 7/1975 | Taylor | 128/64 |
| 3,937,215 | 2/1976 | Barthlome | 128/26 |
| 3,937,216 | 2/1976 | Brown . | |

(List continued on next page.)

FOREIGN PATENT DOCUMENTS

| | | | |
|---|---|---|---|
| 1133347 | 10/1982 | Canada | 128/40 |
| 0961692 | 10/1982 | U.S.S.R. | 128/26 |
| 1489683 | 10/1977 | United Kingdom | 128/64 |
| 2026315 | 2/1980 | United Kingdom | 5/441 |

*Primary Examiner*—Edgar S. Burr
*Assistant Examiner*—Kimberly L. Asher
*Attorney, Agent, or Firm*—Pearne, Gordon, McCoy & Granger

[57] ABSTRACT

A cyclically inflatable, passive motion device which includes an air pump and air reservoir to provide a supply of pressurized air without transients. The air is directed by a selector valve to one of a plurality of paths each of which has a check valve which releases at a different pressure. A four-way solenoid valve directs the pressurized air to an inflatable support. The support may have any one of a number of shapes to move different parts of the body. One embodiment used for the neck includes two saddle-like, inflatable cushion members having legs which define a yoke-like opening that fits around the user's neck. A foam rubber envelope fits over the cushion, and they all fit inside of a cover. A second embodiment of the support includes an inflatable cushion having separate compartments which are alternately inflated and deflated. The compartmentalized cushion fits in a resilient cover and may be used with a heating pad. Other cushions are designed to support and move the knee and fingers.

12 Claims, 3 Drawing Sheets

U.S. PATENT DOCUMENTS

| | | | |
|---|---|---|---|
| 3,942,518 | 3/1976 | Tenteris | 128/64 |
| 4,060,863 | 12/1977 | Craig | 5/441 |
| 4,071,031 | 1/1978 | Lowman | 5/441 |
| 4,099,523 | 7/1978 | Lowrey . | |
| 4,146,021 | 3/1979 | Brosseau et al. . | |
| 4,161,794 | 7/1979 | Darnfors | 5/441 |
| 4,175,297 | 11/1979 | Robbins et al. | 5/447 |
| 4,193,149 | 3/1980 | Welch | 5/453 |
| 4,236,264 | 12/1980 | Britzman | 5/441 |
| 4,266,537 | 5/1981 | Bonin, Jr. et al. . | |
| 4,320,749 | 3/1982 | Highley . | |
| 4,408,599 | 10/1983 | Mummert | 128/24 R |
| 4,445,504 | 5/1984 | Barge . | |
| 4,516,568 | 5/1985 | Baxter et al. . | |
| 4,539,978 | 9/1985 | Lundblad . | |
| 4,583,522 | 4/1986 | Aronne | 128/24 R |

FLUID-ACTUATED MEDICAL SUPPORT

This is a continuation, of application Ser. No. 06/864,769, filed on May 19, 1986.

BACKGROUND OF THE INVENTION

This invention is in the field of fluid-actuated traction and passive motion devices.

It is well established that traction is a medical benefit to some forms of vertebral disorders. The vertebral column is a rather fragile, major structural component of the body, and as such is particularly subject to stresses that cause dislocation or other misalignment of individual vertebrae or abnormal function and wear of vertebral joints. When a vertebrae becomes misaligned or its articulations diseased, it may pinch one or more of the nerves that run through the spinal column or cause muscle pain and/or spasm. Such pinched nerves are extremely painful and often impair the function of a limb which it controls and painful and spastic muscles cause disfunction of the spine.

Traction has been found to give relief to pinched nerves and painful, spastic muscles by putting the vertebral column and its supporting structures under tension, thereby relieving the immediate cause of discomfort to the patient.

The vertebrae in the neck are particularly vulnerable because of their lack of support and the required work of the supporting ligaments and muscles. As a result, many traction devices have been designed for the neck. An example of an intermittent traction device is shown in U.S. Pat. No. 3,420,229. It is a large, complex device that appears to be designed for use in a hospital. It includes a bed on which the patient lies and has a strap that holds and pulls the patient's head.

A pneumatic cylinder has been suggested as a substitute for weights or levers in U.S. Pat. No. 3,937,216. However, this still must be used in conjunction with a bed, straps, etc. Clearly, none of the prior art devices provide a lightweight, portable traction device.

Passive motion is a relatively recent technique of constantly motivating some body part from an external power source. The technique has been found useful as a post-operative technique for backs, knees, elbows, wrists, fingers, etc. to give increased mobility at an early time.

Many complex passive motion devices have been designed. Almost all of them can be used for only one joint, and all of them are a heavy, complex amalgamation of bars, motors, gears, levers, pulleys, and cables. Moreover, the present machines are so expensive that a purchase for home use without some form of financial aid would be unreasonable for the vast majority of people. Accordingly, the use of passive motion machines is severely limited.

It is the purpose of this invention to provide a reliable, simple, effective, lightweight, and inexpensive device that can provide both traction and passive motion. The present invention provides these qualities by using the principle of periodic inflation and deflation of a support with a fluid under pressure. In some cases, the support is designed to move or put different parts of the human body under tension, and, in other cases, to simply put them in motion. A small fluid compressor, an inflatable cushion with appropriate valves and conduits, and a timer are the basic components needed to achieve the desired results. All of the necessary components fit into a small, light case that can be easily transported and used at home, as well as while traveling. Moreover, the small number of components make this device much less expensive than prior art devices.

SUMMARY OF THE INVENTION

A cyclically inflatable and deflatable support device, including a means for periodically pressuring a system with fluid and a means for directing the fluid along different paths operatively connected to the means for pressurizing, is disclosed. Inflatable cushions adapted to fit different parts of the body are connected to the directing means.

DETAILED DESCRIPTION OF THE DRAWINGS

Figure 1:
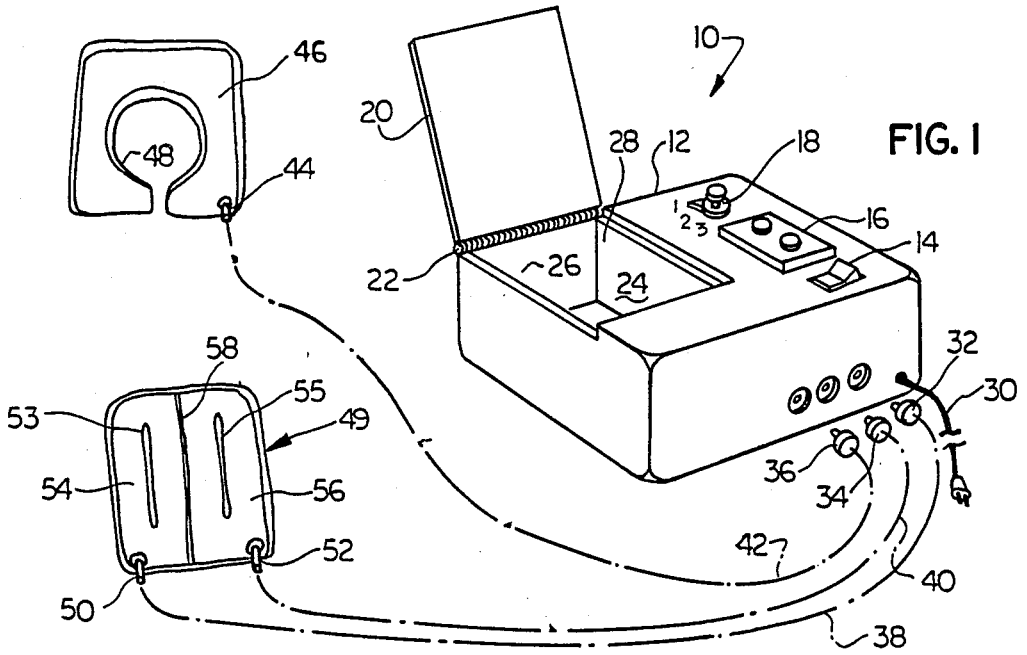
FIG. 1 shows a perspective view of the system of this invention.

FIG. 1 illustrates the general exterior of a typical inflatable support device 10 which includes a case 12 housing the operable components. It has an on-off switch 14, a timing cycle control 16, and a pressure selector switch 18. A door 20 and hinge 22 with the case 12 partially defines a compartment 24 having side walls 26, 28, and two additional side walls not visible in FIG. 1. The compartment 24 is so sized that it will hold a deflated cushion and the appropriate flexible conduits.

An electrical plug 30 plugs into a power source for the internal driving means. Plugs 32, 34, and 36 are operatively connected to flexible conduits 38, 40 and 42, respectively. The plug 36 and conduit 42 are operatively connected to another plug 44 on a neck support 46 having a generally yoke-shaped opening 48 which is designed to fit around the patient's neck. Plugs 32 and 34 and conduits 38 and 40 act as the fluid supply to cushion 49 having connectors 50 and 52 for the compartments 54 and 56, which are held in fluidtight isolation from each other by a seam 58. Line seals 53 and 55 simply hold the center of each compartment in position. Without expressly stating so, every cushion described herein is assumed to be fluidtight and flexible. The design of the cushions is such that there is enough material to allow expansion of each fluidtight compartment upon pressurization thereof. While the device may be used with two different inflatable cushions as shown, it will normally only be used with one cushion at a time. However, each cushion may have a plurality of air bladders.

Figure 2:
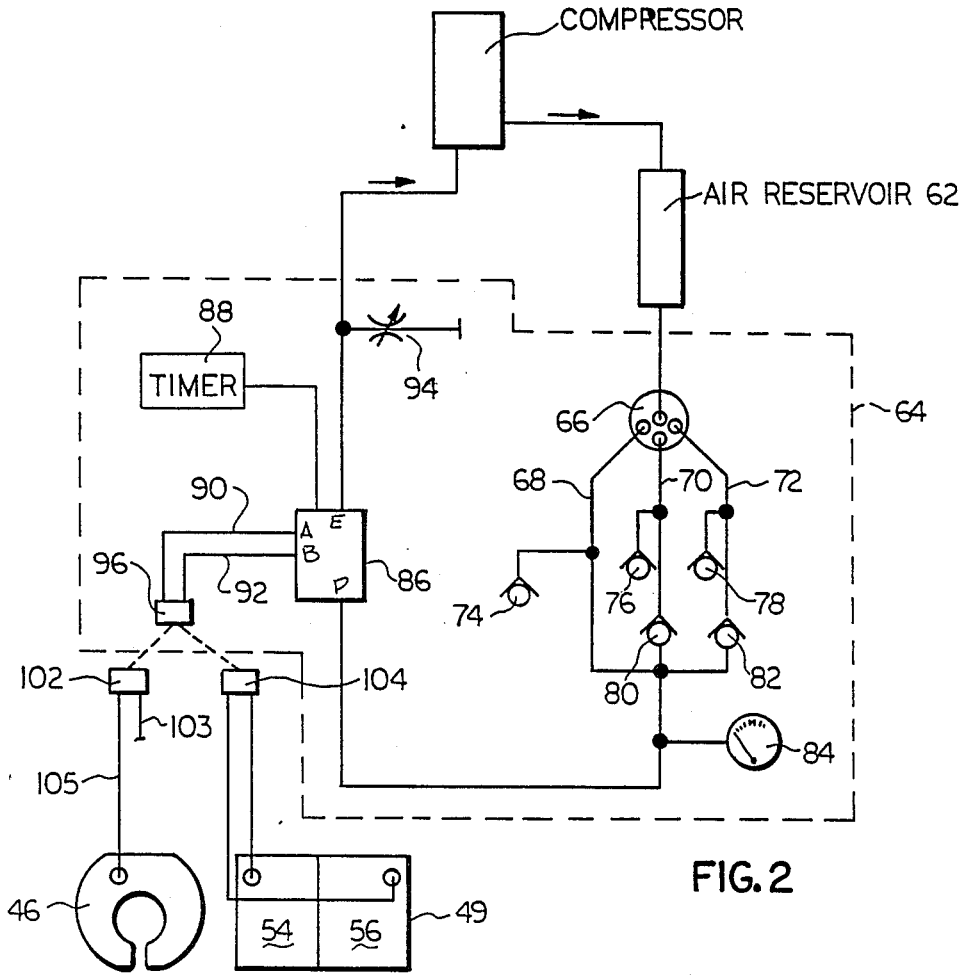
FIG. 2 is a block diagram of functional components of this invention.

FIG. 2 illustrates a block diagram of the cyclical, inflatable support device of this invention. It includes a means for periodically pressurizing the system which includes a compressor 60 and an air reservoir 62 which are operatively connected by an appropriate conduit. It should be understood that while this invention will be described with respect to fluids in general, pneumatics are preferred, but it is possible to utilize the concepts of this invention using liquid.

A means for directing the fluid along different paths is operatively connected to the means for periodically pressurizing, and is shown in the dotted block 64. It includes a manually operable selector valve 66 and conduit paths #1, #2, and #3 which have been numbered 68, 70, and 72, respectively. In each conduit path is a pressure relief valve 74, 76, and 78, respectively. Each of the check valves has a relief pressure, and may be adjusted according to the requirements of the system. For example, an operable combination that has been found to be successful is 1.5 psi for conduit 68, 1.0 psi for conduit 70, and 0.5 psi for conduit 72. The remaining two check valves 80 and 82 may also be adjusted to the needs of the system, but a typical example of a relief pressure for them is 0.3 psi. These latter two check valves are used to prevent reverse flow. A pressure gauge 84 allows the user to monitor the pressure in the system.

A four-way solenoid valve 86 or other switching means is operatively connected to an electrically-actuated timer 88 or other signaling means. The valve 86 switches the fluid conduit passageway between conduits 90 and 92. A flow control 94 is operatively connected to the solenoid valve 86 to permit a release of fluid at a predetermined rate and may be manually or electrically adjusted for different flow rates. A fluid plug 96 is included in the means for directing and is designed to be attached to complementary plugs in the different cushions.

Two examples of the types of inflatable cushion means are shown as 46 and 49. Included with these inflatable cushions are appropriate plugs 102 and 104 to be attached to plug 96. In all cases, conduits appropriately and operatively attaching various components are needed, as will be obvious to one skilled in the art, and should be considered connected to each support. The neck support 46 has been generally described above, as well as the two-compartment support 49.

In operation, the compressor is generally sized for the condition, the amount of air, and the pressure required, but it has been found that a pressure going up to 6 psi, such as Model No. VPQ125, manufactured by Medo Co., has been satisfactory. The compressor distributes this pressurized air to an air flow reservoir through a conduit in order to remove transient high pressures, or "spikes" as they are sometimes called. The air reservoir facilitates an even pressurized flow to the selector valve 66, such as that manufactured by Norgren Corp., Model No. 5CU-023-000, which in effect, has its position chosen by the selector 18 to one of the paths #1, #2, or #3. If the position #1 is chosen, air flow of about 1.5 psi (the release pressure of relief valve 74) will flow through conduit 68 and into the system. Check valves 80 and 82 will prevent any reverse flow. Similarly, selection of paths #2 or #3 will cause the fluid to pass through conduits 2 or 3, and will be held at the pressure governed by pressure relief valves 76 and 78, which in this case are 1 psi and 0.5 psi, respectively. Other operating pressures may be selected.

The fluid travels from one of the passageways to solenoid valve 86. In one position, the ports B to P are connected and parts A to E are connected. Pressurized fluid conveyed through conduit 92 goes into one chamber 56. At the same time, chamber 54 is being deflated by the vacuum side of the compressor operating through the conduit 90 and ports A to E. When the timer causes the solenoid valve to switch positions, ports P and A are connected, with the reverse flow back through ports B and E. The timer makes the time for inflation variable from about 0.5 to 4 minutes, but other cycles may be used. It is important to realize that the deflation rate may be varied independently from the inflation rate with the aid of center flow control valve 94. The valve 94 allows faster deflation of the chambers if so desired, and thus provides the ability to deflate at a different rate from the inflation cycle.

If the plug 96 is connected to the plug 102, the operation is much the same, except that there is a bleed line 103. Both the inflate and deflate cycles, i.e., pressure and vacuum, go through conduit 105 in this case.

The force generated by the inflatable cushions will depend upon their area. However, in a unit typically having about 10 square inches, a pressure of 1.5 psi will give about 15 pounds of force, which is #1 position. No. 2 position, using 1 psi would give 10 pounds of force, etc.

Figure 3:
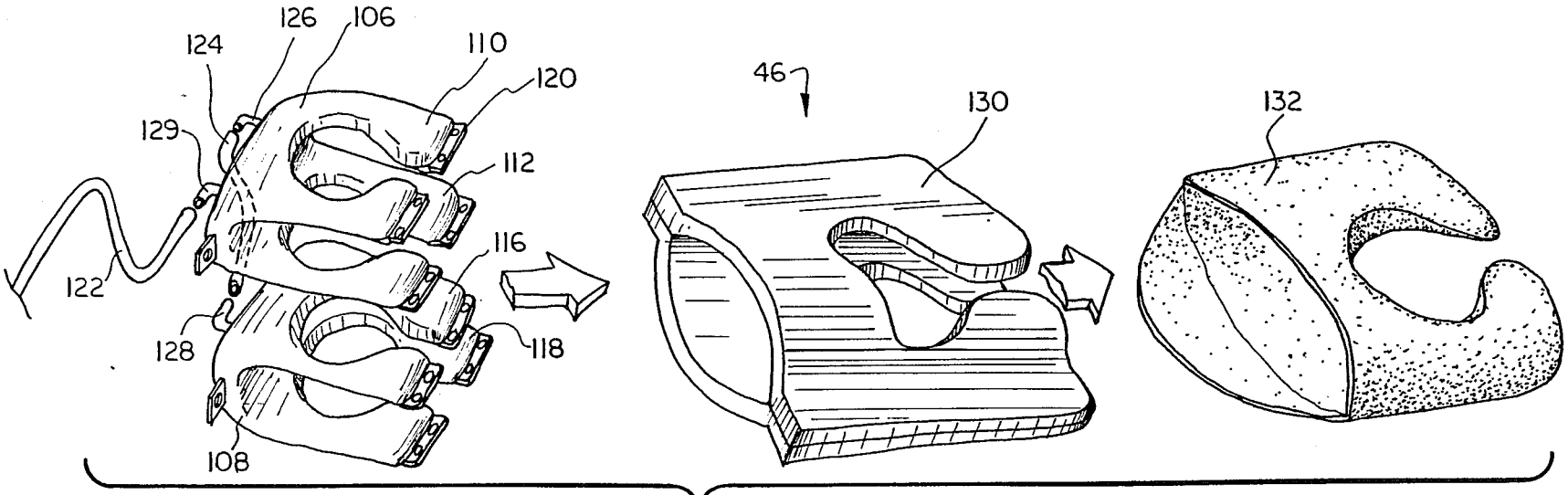
FIG. 3 illustrates a perspective view of the components of a neck support.

The neck cushion 46 is shown in particular in FIG. 3, and includes a first saddle-shaped cushion 106 and a second saddle-shaped, inflatable cushion 108. Each of the cushions has two pairs of legs 110, 112, 116, 118, respectively, which define yoke-shaped openings, permitting them to be placed around a patient's neck. Openings such as shown at 120 are situated on the ends of each leg so that they may be laced together. Fluid conduit 122 provides an inlet to the cushions 106 and 108 in conjunction with conduit 124 and appropriate L-shaped plugs 126, 128, and 129. Any type of fluidtight connection may be utilized, such as male and female threads, friction heads, snap connectors, etc. The cushions 106 and 108 are designed to fit into a foam envelope 130 which has generally the same shape. The envelope 130 is a type of foam rubber or polymer in order to be more comfortable for the patient. A cover 132 holds all of the previously mentioned elements in position. The cushions may be made of rubber or any one of a number of polymers.

Figure 4:
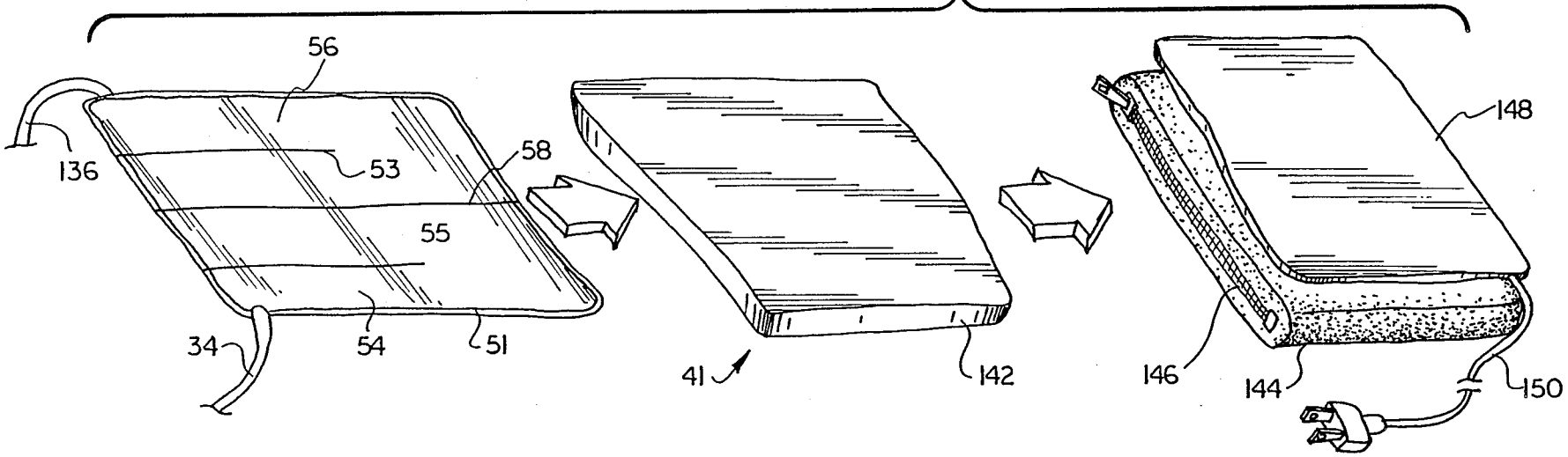
FIG. 4 is a perspective view of a back support.

In FIG. 4, a back cushion 49 generally includes a flexible fluidtight envelope 51 having a first connecting conduit 134 and a second conduit 136 to the two side-by-side compartments 54 and 56, respectively. A sealed fluidtight seam 58 separates the two compartments so that they may be alternately inflated and deflated. Additional seams 53 and 55 are optionally utilized to give the cushion a desired shape. By alternately inflating and deflating each portion, a rocking or oscillating motion may be generally imparted to the lower back or longitudinally on the spine. Again, a foam pad 142 may be utilized with the cushion 49 to impart a softer surface to the patient. A case 144, which has a zipper opening 146, holds the entire assembly and may alternately be used with a heating pad 148. An electrical plug 150 supplies power for the electric pad.

It has been found that the continuous motion, particularly when used with the heat, provides a gentle relaxation of the lower back muscles. Larger cushions appropriately positioned could be used to treat bedsores caused by prolonged bed rest in one position.

Figure 5:
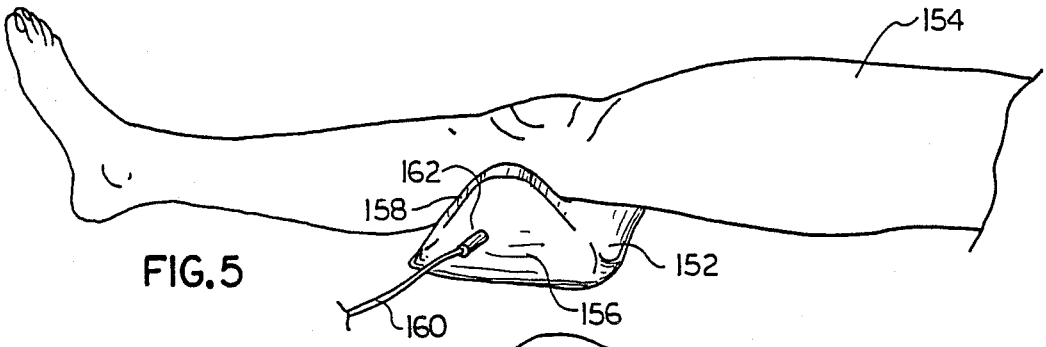
FIGS. 5 and 6 are perspective views of an inflatable knee support.
Figure 6:
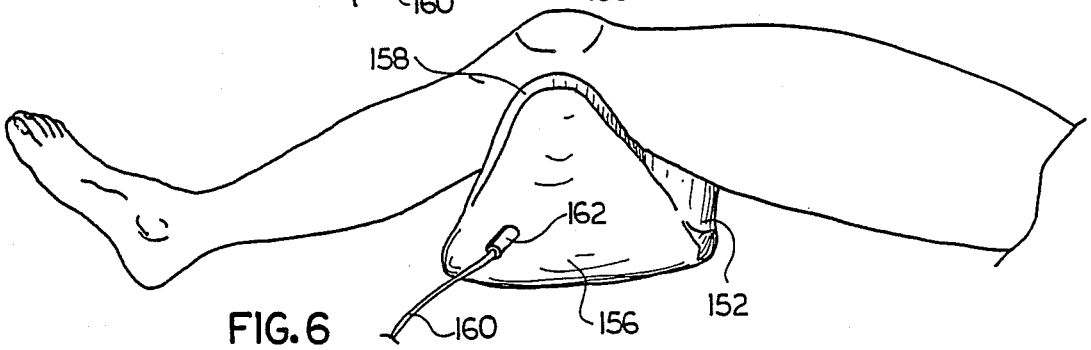

FIGS. 5 and 6 illustrate a type of inflatable cushion that is particularly adapted for passive motion of the knee. Following knee surgery, it is very common for lesions or scar tissue to build up, which hinders the movement of the knee. To reduce lesion build-up and generally promote faster healing, various devices have been suggested for keeping the knee in motion. They generally have a complex assembly of rods, pulleys, etc. which are heavy, hard to transport, and often difficult to use in the environment of a hospital bed and extremely hard to use in a home. The cushion 152, which can be placed under the patient's leg 154, is generally triangular in cross section and has sides 156 and upwardly extending ears 158 (only one shown). The upwardly extending ears 158 form part of a concave portion at the top of the cushion 152. The concave portion holds the leg in position and stops it from rolling toward either side. During the inflation cycle, air enters through conduit 160 to connector 162 into the cushion 152. The connector 162 may be any one of a number of types. The knee bends, as shown in FIG. 6, during the inflation cycle. After an elapsed time chosen by the doctor or patient, but generally in the area of half a minute to four minutes, the cushion deflates. The deflation position is shown in FIG. 5 and illustrates how the knee straightens. Again, the time of each part of the cycle may be varied. There are many advantages in the use of the present invention, in that it is lightweight, portable, easily set up, and does not catch on bedding.

Figure 7:
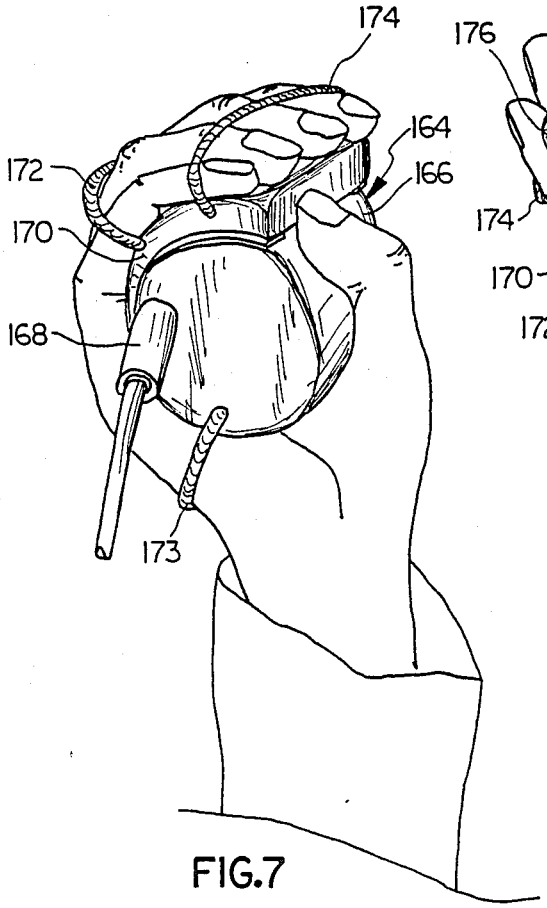
FIGS. 7 and 8 are perspective views of an inflatable hand support.
Figure 8:
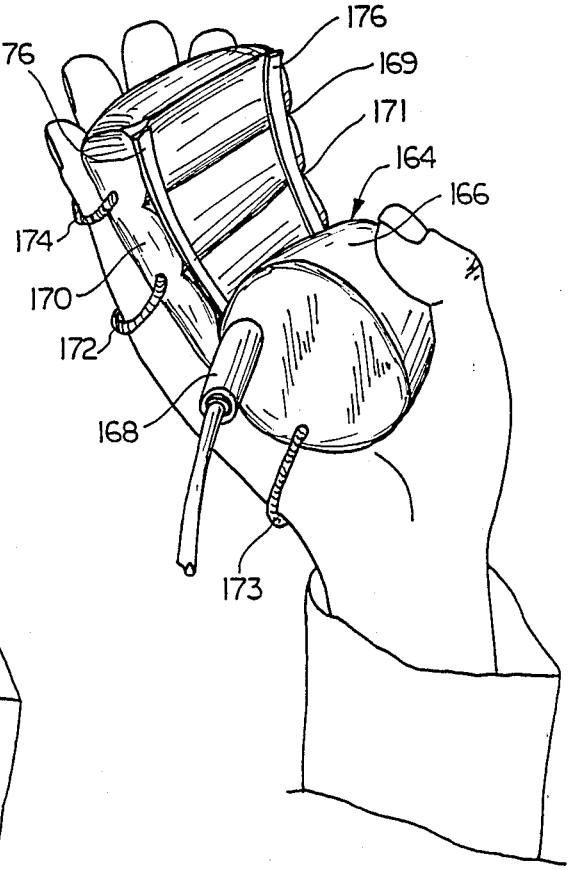

FIG. 7 illustrates an additional type cushion 164, which is particularly adapted for passive motion of the fingers. The cushion 164 includes a softer element which is held in the palm of the hand 166, which may be foam rubber, a polymer, or some other comfortable material. A connector 168 is included in the cushion and receives fluid from a conduit. A deflatable portion 170 of the cushion is generally rectangular in shape and has recessed ribs 169 and 171. Elastic bands 172, 173, and 174 attach to the cushion and fit over the hand to hold it in place. Biased, flexible strips 176, which may be metal or a polymer, cause the cushion 164 to roll up when it is deflated, thus bending the fingers as shown in FIG. 7. During the inflation cycle, the cushion straightens itself and the patient's fingers by counteracting the force of the strips 176. Biasing means other than strips 176 could be used, such as elastic bands connected between the end of the fingers and the wrist.

While the invention has been shown and described with respect to particular embodiments thereof, this is for the purpose of illustration rather than limitation, and other variations and modifications of the specific embodiments herein shown and described will be apparent to those skilled in the art within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. A cyclically inflatable body support device comprising:

a means for periodically pressurizing and depressurizing a system with fluid;

means for directing the fluid along a plurality of different fluid paths including a selector valve operatively connected to the means for pressurizing and depressurizing, the means for directing further including a plurality of pressure regulation means including pressure relief valves for adjusting independently different fluid pressures in each different fluid path, a plurality of check valves in the fluid paths to permit flow in one direction only, a switching valve receiving fluid flow from said pressure relief valves, an operatively connected timing means for switching from a first pressurizing position to a second non-pressurizing position, and a flow control valve operatively connected to the switching valve, which gradually releases fluid at a controlled rate whereby the rate of deflation may be controlled independently from the rate of inflation; and an inflatable flexible cushion means operatively connected to the means for directing, the cushion means having at least two separate side-by-side compartments for a part of the body, the compartments being attached to different fluid inlets so that the compartments expand and contract and thereby impart a slow passive rocking motion;

wherein expansion is caused by receipt of pressurized gas from said means for periodically pressurizing and depressurizing via said means for directing, and contraction results from the gradual release of fluid caused by said timing means, said flow control valve, and said means for pressurizing and depressurizing.

2. The cyclically inflatable body support device of claim 11, wherein the means for pressurizing and depressurizing includes an air reservoir operatively connected to a compressor so that transient pulses are not conveyed to the rest of the device.

3. The cyclically inflatable body support device of claim 2, wherein the switching valve is a timed solenoid valve that alternately switches the fluid flow to different compartments in the fluidtight flexible cushion while a previously inflated compartment is allowed to deflate.

4. The cyclically inflatable body support device of claim 3, wherein the cushion is located in a resilient envelope.

5. The cyclically inflatable body support device of claim 4, wherein a heated pad covers the resilient envelope.

6. A cyclically inflatable body support device comprising:

a means for periodically pressurizing and depressurizing a system with fluid;

means for directing the fluid along a plurality of different fluid paths including a selector valve operatively connected to the means for pressurizing and depressurizing, the means for directing further including a plurality of pressure regulation means including pressure relief valves for adjusting independently different fluid pressures in each different fluid path, a plurality of check valves in the fluid paths to permit flow in one direction only, a switching valve receiving fluid flow from said pressure relief valves, an operatively connected timing means for switching from a first pressurizing position to a second non-pressurizing position, and a flow control valve operatively connected to the switching valve, which gradually releases fluid at a controlled rate whereby the rate of deflation may be controlled independently from the rate of inflation; and an inflatable flexible cushion means operatively connected to the means for directing so that the compartment expands and contracts; wherein expansion is caused by receipt of pressurized gas from said means for periodically pressurizing and depressurizing via said means for directing, and contraction results from the gradual release of fluid caused by said timing means, said flow control valve, and said means for pressurizing and depressurizing.

7. The cyclically inflatable body support device of claim 6, wherein the cushion has a yoke-shaped central opening which can be inserted around the user's neck.

8. The cyclically inflatable body support device of claim 7, wherein the cushion means includes a second fluidtight flexible cushion, both of the cushions having a saddle-shape with a yoke-shaped central opening defined by a pair of legs.

9. The cyclically inflatable body support device of claim 8, wherein the cushions are operatively connected to expand and deflate together and are positioned by a cover which holds them in place so that the upward forces around a user's chin and neck are generally uniform.

10. The cyclically inflatable body support device of claim 9, wherein a resilient sleeve surrounds the cushions and fits inside the cover.

11. The cyclically inflatable body support device of claim 6, wherein the inflatable flexible cushion has a generally triangular cross section and a concave top portion to cradle user's knee and cause it to bend as the cushion is inflated and to straighten as the cushion is deflated.

12. The cyclically inflatable body support device of claim 6, wherein the inflatable flexible cushion generally fits a palm of a user's hand and straightens the fingers as the cushion inflates thereby resilient biasing means work in conjunction with the cushion to cause the fingers to bend when the cushion is deflated, and further including means for holding the cushion and resilient biasing means in the proper position on a user's hand.

* * * * *